US006165699A

United States Patent [19]

Bauer et al.

[11] Patent Number: 6,165,699

[45] Date of Patent: Dec. 26, 2000

[54] ANNEALED ADHESION PROMOTING LAYER FOR PHOTOGRAPHIC IMAGING ELEMENTS

[75] Inventors: Charles L. Bauer, Webster; Cathy A. Fleischer, Rochester, both of N.Y.

[73] Assignee: Eastman Kodak Company, Rochester, N.Y.

[21] Appl. No.: 09/466,566

[22] Filed: Dec. 17, 1999

[51] Int. Cl.[7] ..... G03C 1/93; G03C 1/795; G03C 1/74; G03C 11/22

[52] U.S. Cl. ..... 430/349; 430/533; 430/535; 430/935; 427/386

[58] Field of Search ..... 430/349, 535, 430/533, 935; 427/386

[56] References Cited

U.S. PATENT DOCUMENTS

| | | | |
|---|---|---|---|
| 3,501,301 | 3/1970 | Nadeau et al. . | |
| 3,645,740 | 2/1972 | Nishio et al. | 430/535 |
| 4,098,952 | 7/1978 | Kelly et al. | 428/483 |
| 4,128,426 | 12/1978 | Ohta et al. | 430/534 |
| 4,141,735 | 2/1979 | Schrader et al. | 430/533 |
| 4,328,283 | 5/1982 | Nakadate et al. | 430/534 |
| 4,609,617 | 9/1986 | Yamazaki et al. | 430/535 |
| 5,496,687 | 3/1996 | Kawamoto | 430/349 |
| 5,580,709 | 12/1996 | Kobayashi et al. | 430/533 |
| 5,618,657 | 4/1997 | Rieger et al. | 430/531 |
| 5,677,116 | 10/1997 | Zengerle et al. | 430/534 |
| 5,718,981 | 2/1998 | Fleischer et al. | 430/535 |
| 5,759,756 | 6/1998 | Laney et al. | 430/535 |
| 5,968,646 | 10/1999 | Grace et al. | 430/533 |

FOREIGN PATENT DOCUMENTS

| | | |
|---|---|---|
| 0 035 614 | 7/1981 | European Pat. Off. . |
| 2 037 792 | 11/1979 | United Kingdom . |
| 2 046 626 | 3/1980 | United Kingdom . |
| 1 583 343 | 4/1981 | United Kingdom . |

*Primary Examiner*—Richard L. Schilling
*Attorney, Agent, or Firm*—Charles P. Konbol

[57] ABSTRACT

A photographic polyester support having an adjacent subbing layer which comprises a polymer or copolymer of glycidyl acrylate and/or glycidyl methacrylate followed by a gelatin layer and which is annealed. Such a composite has been found to provide improved adhesion properties without chemical degradation of the subbing layer under annealing conditions.

12 Claims, No Drawings

ANNEALED ADHESION PROMOTING LAYER FOR PHOTOGRAPHIC IMAGING ELEMENTS

FIELD OF THE INVENTION

This invention relates to a photographic element, wherein a polyester support is subjected to a subbing treatment by first coating the polyester support with a layer of an aqueous dispersion of a glycidyl (meth)acrylic polymer, secondly coating said subbing layer with a gelatin-containing layer, and thirdly, annealing the coated support

BACKGROUND OF THE INVENTION

Polyester films are widely used as a support for light-sensitive silver-halide photographic materials, on account of its excellent physical properties for that purpose. However, a practical difficulty often arises in the course of attempting to produce and maintain a strong adhesive force between the polyester support and an overlying photographic emulsion comprising a binder such as gelatin, because the polyester film is of a very strongly hydrophobic nature and the emulsion is a hydrophilic colloid.

If the adhesion between the photographic layers and the support is insufficient, several practical problems arise. If the photographic material is brought into contact with a sticky material, such as splicing tape, the photographic layers may be peeled from the support resulting in a loss of image-forming capability. In the manufacturing process, the photographic material is subjected to slitting or cutting operations and in many cases perforated holes are punched into the material for film advancement in cameras and processors. Poor adhesion can result in a delamination of the photographic layers from the support at the cut edges of the photographic material, which can generate many small fragments of chipped-off emulsion layers which then cause spot defects in the imaging areas of the photographic material.

The foregoing property may be referred to as "dry adhesion." This property may be distinguished from "wet adhesion" which refers to the tendency of a photographic element to delaminate during wet processing of exposed film. The element may undergo spot delamination or blistering due to processing at elevated temperatures with typical development solutions or may be damaged by transport rollers during processing or subsequent thereto.

Another variation on this problem is "blocking," which occurs during the manufacturing of the photographic element, when a continuous web coated with the subbing layer is wound in roll form before application of the emulsion layers. In this instance, the front side containing the subbing layer is brought into intimate contact with the coating on the back side, which sides can then stick or block together. This prevents or makes difficult the unwinding of the roll for the application of subsequent coatings.

Various subbing processes and materials have, therefore, been used or proposed in order to produce improved adhesion between the support film and the hydrophilic colloid layer. For example, a photographic support may be initially treated with an adhesion promoting agent such as, for example, one containing at least one of resorcinol, catechol, pyrogallol, 1-naphthol, 2,4-dinitrophenol, 2,4,6-trinitrophenol, 4-chlororesorcinol, 2,4-dihydroxy toluene, 1,3-naphthalenediol, 1,6-naphthalenediol, acrylic acid, sodium salt of 1-naphthol-4-sulfonic acid, benzyl alcohol, trichloroacetic acid, dichloroacetic acid, o-hydroxybenzotrifluoride, m-hydroxybenzotrifluoride, o-fluorophenol, m-fluorophenol, p-fluorophenol, chloral hydrate, and p-chloro-m-cresol.

Polymers are also known and used in what is referred to as a subbing layer for promoting adhesion between a support and an emulsion layer. Examples of suitable polymers for this purpose are disclosed in U.S. Pat. Nos. 2,627,088; 2,968,241; 2,764,520; 2,864,755; 2,864,756; 2,972,534; 3,057,792; 3,071,466; 3,072,483; 3,143,421; 3,145,105; 3,145,242; 3,360,448; 3,376,208; 3,462,335; 3,475,193; 3,501,301; 3,944,699; 4,087,574; 4,098,952; 4,363,872; 4,394,442; 4,689,359; 4,857,396; British Patent Nos. 788, 365; 804,005; 891,469; and European Patent No. 035,614. Often these include polymers of monomers having polar groups in the molecule such as carboxyl, carbonyl, hydroxy, sulfo, amino, amido, epoxy or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers. Additional examples are polymers of, for example, acrylic acid esters such as ethyl acrylate or butyl acrylate, methacrylic acid esters such as methyl methacrylate or ethyl methacrylate or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers. Materials used in adhesion-promoting layers often comprise a copolymer containing a chloride group such as vinylidene chloride.

One commonly practiced process for providing good adhesion of photographic emulsions to polyester supports involves applying an adhesion-promoting layer or subbing layer to the polyester support followed by a coating of gelatin or other hydrophillic colloid material on top of the subbing layer.

Another composition proposed for solving the above-mentioned problem of the weak adhesion force between a polyester support and the emulsion is in Japanese Laid-Open-to-Public Publication No. 11118/1974. A polyester film support is subbed with an aqueous dispersion containing an emulsified copolymer of diolefins and a compound having at least two ethyleneimino groups. Although such a subbing layer was found to have excellent film adhesion characteristics when in a wet state during development treatment and even when in a dry state after drying subsequent to development, nevertheless when such light-sensitive silver-halide photographic materials were processed with an automatic developing machine, wherein the photographic materials were rubbed with a transferring rack or rubber roll of the automatic developing machine, a so-called edge-peel phenomenon was observed, wherein the silver halide photographic emulsion layer were observed to be peeled off from the support at the edges of said photographic materials.

A process intended to overcome the above-mentioned drawback was proposed in Japanese Laid-Open-to-Public Publication No. 104913/1977, wherein a polyester film support was coated with a copolymer of glycidyl methacrylate and ethyl acrylate to form a copolymer sub layer and a gelatin layer comprising colloidal silica was then coated on the copolymer sublayer. A drawback of this process, however, was that a cracking phenomenon was observed in the sublayer under drying treatment with the result that the sub layer thus formed deteriorated in its transparency.

It is also well known to improve the adhesive strength between a layer adjacent to a support and the surface of the support by way of a surface treatment. Examples of these surface activation treatments include, but are not limited to: chemical treatment, mechanical treatment, corona discharge, flame treatment, UV irradiation, radio-frequency treatment, glow discharge, plasma treatment, laser treatment, acid treatment, and ozone-oxidation. Specifics on such treatments may, for example, be found in Hatsumei Kyoukai Koukai Gihou No. 94-6023 and U.S. Pat. No. 5,425,980. Such treatment may be employed with or without the application of a subbing layer.

Some photographic applications require the support to be annealed at high temperatures to provide core set properties, especially smaller sized films (e.g., APS films) utilizing supports made from PEN (polyethylene napthalate). See, for example, U.S. Pat. No. 5,759,756 to Laney et al, which discloses biaxially oriented photographic film supports. Laney et al describes annealing the support while it is wound on a core, at a temperature of from 50° C. up to the lowest Tg of one of the outer layers of film base. Typical annealing conditions for a film base containing a PEN layer are temperatures of from 90° C. to 125° C. for times of 6 to 120 hours. In one example, annealing conditions for samples were 100° C. for 24 hours. The purpose of such annealing is to increase the toughness of the film support and to cause it to resist curl and core set. Laney et al states that the preferred method for promoting adhesion is glow discharge.

In attempting to improve adhesion of films subjected to annealing temperatures, Applicants found that chloride-containing polymers, such as the commonly used vinylidene chloride subbing material, degrade and thereby decrease the adhesion performance of the system, which can cause roll blocking. This material also makes recycling of the support material difficult.

Although apparently experiencing little commercial use, glycidyl-containing polymers have been proposed for improving the adhesion of a light-sensitive emulsion to a polyester support. For example, U.S. Pat. No. 4,328,283 to Nakadata et al. discloses a polyester support on the surface thereof with a subbing layer formed by coating the support surface with an aqueous composition containing a copolymer consisting of the following components: (1) 30–70 wt % glycidyl acrylate and/or glycidyl methacrylate monomer, (2) 3–45 wt % hydroxyalkyl acrylate having an alkyl group of 2 to 4 carbon atoms and/or hydroxyalkyl methacrylate monomer, and (3) 0–67 wt % a copolymerizable vinyl monomer. It was found that wet-film adhesion force was low in the case when less than 30 wt % of the first component was present, and dry-film adhesion force deteriorated when more than 70 wt % was present.

U.S. Pat. No. 3,645,740 to Nishio describes photographic elements that use a blend of gelatin with either a glycidyl methacrylate or glycidyl acrylate homo or copolymer as subbing layers for PET supports. Besides providing adhesion, the coating solutions were found to have good stability and wound coated rolls did not block.

U.S. Pat. No. 4,098,952 to Kelly et al describes a primer for PET supports which contains a copolymer that comprises 3–25 mole % glycidyl (meth)acrylate. U.S. Pat. No. 4,128,426 to Ohta et al describes a subbing layer for photographic film which comprises a copolymer containing 20 to 90% glycidyl (meth)acrylate. U.S. Pat. No. 4,609,617 to Yamazaki et al describes a subbing layer for photographic film comprising a copolymer containing 0.01% to 70% glycidyl (meth)acrylate. GB 1583343 to Mann describes a subbing layer for photographic elements that contains copolymers of acrylic acid or methacrylic acid and their derivatives such as glycidyl (meth)acrylate. GB 2037792 to Kitihara et al describes subbing layers for photographic polyester supports that use copolymers containing 35–55 wt % glycidyl (meth)acrylate. The subbing layer is applied during the manufacturing of the PET (polyethylene terephthalate), and the applied subbing layer is then subjected to corona discharge treatment before applying additional layers. Other patent publications which disclose, in general, the use of a copolymer containing glycidyl methacrylate as a subbing layer for photographic include JP 5134356, JP 59094756, and EP 35614. A research disclosure, RD 18358 1979, describes the use of a butyl acrylate-glycidyl methacrylate-styrene (40-40-20) copolymer as a subbing layer for photography. Notwithstanding the above disclosures, subbing layers comprising glycidyl (meth)acrylic have not experienced widespread commercial application, suggesting that such proposed subbing materials and processes are either not economical and/or do not provide the desired performance characteristics for commercial application.

It is accordingly a primary object of the present invention to provide subbed polyester supports for photographic use wherein excellent film adhesion adhesion to a hydrophilic colloid layer such as a photosensitive emulsion are obtained.

SUMMARY OF THE INVENTION

It has been found that the use of a subbing layer containing a glycidyl-functional polymer, in combination with an overlying non-photosensitive gelatin containing layer, and in combination with annealing, significantly improves the adhesion of a photographic emulsion to a polyester support, without degradation due to the annealing. The invention is, therefore, directed to a process for preparing a photographic element, comprising in-line coating and annealing of a polyester web with a glycidyl-containing polymer.

The invention is also directed to a silver-halide photographic light-sensitive material exhibiting good wet adhesion between the photographic emulsion layers and a polyester support that is a high Tg core set photographic support. One embodiment comprises a glycidyl-containing sub layer over a support comprising PEN (polyethylene naphthalate), PET (polyethylene terephthalate), including blends of PEN with, or coextrusion with, a lower Tg polyester such as PET.

DETAILED DESCRIPTION OF THE INVENTION

This invention relates to polyester supports in a photographic element, wherein the support is subjected to subbing treatment by, first, coating a polyester support with a first layer of a material comprising a glycidyl-functional polymer, second, applying a non-photosensitive gelatin-containing layer over the first layer and, third, annealing the subbing layer onto the support, in order to promote adhesion with a subsequent photosensitive emulsion layer.

By the term "glycidyl functionality" is meant a group comprising an oxirane ring attached to an alkyl group having one to four carbon atoms, preferably a methyl group.

According to one embodiment of the invention, the above-mentioned objects can be accomplished by applying in-line a coating of a subbing layer comprising a homopolymer of glycidyl methacrylate, hereinafter referred to as GMA, a homopolymer of glycidyl acrylate, hereinafter referred to as GA, or a copolymer of a vinyl monomer with GMA and/or GA. Application of the first layer is followed by a gelatin-containing layer, followed by annealing of the composite while wound on a core. The copolymer may also be a terpolymer containing two or more vinyl monomers.

Optional comonomers to be copolymerized with GMA or GA are monomers that will substantially copolymerize with GMA or GA, which will not react with the glycidyl group during emulsion polymerization and which will effect emulsion polymerization. Suitable vinyl comonomers are, for example, alkyl acrylates, said alkyl group having from one to four carbon atoms; alkyl methacrylates, said alkyl group having from one to four carbon atoms; other substituted alkyl acrylates; acrylamide derivatives; methacrylamide derivatives; vinyl halides such as vinyl chloride; vinylidene halides such as vinylidene chloride; vinylpyrrolidone; other N-vinylamides; vinylpyridines; styrene; styrene derivatives such as alpha-methyl styrene; butadiene; isoprene; acrylonitrile; methacrylonitrile, and the like. The copolymer may be a terpolymer containing two or more vinyl monomers. The proportion of GMA or GA in the copolymer of GMA and/or GA with the vinyl monomer is 50 mole percent or more, preferably more than 70 mole percent, more preferably about 75 mole percent to 100 mole percent. A homopolymer of GMA or GA has been found to provide very excellent adhesion.

Preferably, the above-described polymers having glycidyl functionality are prepared by reacting a polymerizable glycidyl-functional monomer with one or more polymerizable acrylic monomers. Examples of suitable polymerizable acrylic monomers include ethyl acrylate, ethyl methacrylate, butyl acrylate, butyl methacrylate, cyclohexyl acrylate, cyclohexyl methacrylate, methyl acrylate, lauryl acrylate, lauryl methacrylate, allyl methacrylate, hydroxyethyl methacrylate, hydroxyethyl acrylate, and the like. Examples of suitable polymerizable glycidyl-functional monomers include glycidyl methacrylate, glycidyl acrylate, an allyl glycidyl ether.

Though the molecular weight of the polymer used in this invention cannot always be exactly determined because it has may have bridging structure by means of glycidyl groups, it is preferably above 10,000, more preferably more than 50,000.

As hereinabove described, the improved thermally processable imaging element of this invention includes an adhesive interlayer interposed between the imaging layer and the support, which comprises a glycidyl-functional polymer. The glycidyl-functional polymer (inclusive of copolymer and homopolymer) is preferably dispersed as finely divided particles in an aqueous-dispersion medium which is then used as a coating liquid for the formation of the subbing layer. A part of water may be replaced by a water-miscible organic solvent (e.g., methanol or acetone). The polymer of the present invention preferably is prepared by emulsion polymerization, that is, obtained as an aqueous dispersion of particulate emulsion polymerizate, a so-called latex. In general, preparation by emulsion polymerization of the glycidyl-containing polymer in an aqueous composition may be carried out by the following procedure. To an appropriate reaction vessel charged with deaerated distilled water are added monomers selected from the compounds hereinbefore mentioned, followed by addition thereto of suitable amounts of a surface active agent for emulsion polymerization and a water-soluble polymerization initiator, e.g., potassium persulfate or the like. Thereafter, the mixture thus charged is heated with stirring at 50 to 90° C. for several hours to undergo emulsion polymerization. Alternatively, a polymer-containing aqueous composition may also be obtained in the following manner where monomer components are dissolved in an appropriate solvent to prepare a solution, the resulting solution is charged with necessary amounts of a polymerization initiator and polymerization promoter, heated, and then allowed to stand for several hours. Subsequently, the reaction liquid thus obtained is vigorously mixed with an aqueous solvent and a surfactant as an emulsifier.

Aqueous compositions containing the present polymers are preferably used in such a manner that the polymer prepared as an aqueous dispersion according to the aforementioned alternate methods is diluted, if necessary, with water or a water-miscible organic solvent so that the solids concentration in the diluted dispersion of said polymer may become 0.1–10 wt %, though the mode of using the present composition may vary depending on the purpose for which said composition is used and on the coating technique employed therefor. The aqueous compositions may contain a variety of additives besides the above-mentioned polymer. For instance, the aqueous compositions may comprise, in order to improve dispersibility of polymer particles or coatability of the composition at the time of subbing treatment, with anionic surface active agents such as alkali metal or ammonium salts of alcohol sulfuric acid of 8 to 18 carbon atoms; ethanolamine lauryl sulfate; ethylaminolauryl sulfate; alkali metal and ammonium salts of paraffin oil; alkali metal salts of aromatic sulfonic acid such as dodecane-1-sulfonic acid, octadiene-1-sulfonic acid or the like; alkali metal salts such as sodium isopropylbenzenesulfate, sodium isobutylnaphthalenesulfate or the like; and alkali metal or ammonium salts of esters of sulfonated dicarboxylic acid such as sodium dioctylsulfosuccinate, disodium dioctadecylsulfosuccinate or the like; nonionic surface active agents such as saponin, sorbitan alkyl esters, polyethyle oxides, polyoxyethylene alkyl ethers or the like; cationic surface active agents such as octadecyl ammonium chloride, trimethyldosecyl ammonium chloride or the like; and high molecular surface active agents other than those above mentioned such as polyvinyl alcohol, partially saponified vinyl acetates, maleic acid containing copolymers, gelatin or the like. Further, additives which may be incorporated into the present aqueous composition include inorganic matting agents such as titanium oxide, silicon oxide, colloid silica, zinc oxide, aluminum oxide, etc., matting agents comprising particles of polymers such as polymethyl methacrylate, etc., antistatic agents comprising inorganic salts or copolymers and, according to the purpose for which the present aqueous composition is used, dyes or pigments for coloring purposes and alkali or acid for adjusting a pH value of the present polymer-containing composition. Furthermore, the present compositions may also comprise, according to the particular purpose for which they are used, hardeners which include aldehyde-containing compounds such as formaldehyde, glyoxal, and the like; ethyleneimino-containing compounds such as tetramethylene-1,4-bis (ethyleneurea), hexamethylene-1,6-bis(ethyleneurea), and the like, esters of methane-sulfonic acid such as trimethylenebis methanesulfonic acid ester, and the like, active vinyl compounds such as bisacroyl urea, metaxylenedivinylsulfonic acid, and the like, and glycidyl-containing compounds such as bisphenolglycidyl ether, and the like, and isocyanates.

It is also preferable to use coalescing aides, more preferably phenolic or naphtholic type compounds (in which one or more hydroxy groups are substituted onto an aromatic ring), for example, phenol, resorcinol, orcinol, catechol, pyrogallol, 2-4-dinitrophenol, 2,4,6-dinitrophenol, 4-chlororesorcinol, 2-4-dihydroxy toluene, 1,3-naphthalenediol, the sodium salt of 1-naphthol-4-sulfonic acid, o-fluorophenol, m-fluorophenol, p-fluorophenol, o-cresol, p-hydroxybenzotrifluoride, gallic acid, 1-naphthol, chlorophenol, hexyl resorcinol, chloromethylphenol, o-hydroxybenzotrifluoride, m-hydroxybenzotrifluoride, and the like, and mixtures thereof. Chloromethylphenol is especially preferred for use with glycidyl-functional homopolymers. Other coalescing agents include acrylic acid, benzyl alcohol, trichloroacetic acid, chloral hydrate, ethylene carbonate, and combinations of the foregoing. Typically, the concentration of the coalescing aide is about 5–30%, by weight of solids, preferably 10–20%, in the subbing layer.

The particle size of the glycidyl-containing polymer, in an aqueous polymer dispersion, can be controlled by the conditions of the emulsion polymerization in a conventional manner, for example, by controlling the amount of the surface active agent as the dispersing agent, the stirring condition, the reaction time and the reaction temperature. The particle size is preferably within a range of from 0.05 to 1 micron.

The aqueous polymeric composition of the present invention is usually coated and dried on a polyester support at a coverage of approximately 0.3–3 g of polymer solids per $m^2$ of support and in this case the conventional sub layer coating technique is applicable, for example, dip coating, roll coating, spray coating or the like. The coating process may occur anytime during the manufacture of a photographic support such as before biaxial stretching of the support, after machine direction stretching but before transverse stretching or after biaxially stretching. After coating and stretching, the support may be heat relaxed at temperatures over 120° C., generally 100 to 150° C. for several minutes. The final dry coverage after stretching ranges from 30 $mg/m^2$ to 300 $mg/m^2$ based on the weight of the polymer. When the amount is less than the above, the adhesion promoting effect is small.

When the subbing layer has been dried, an additional layer of a gelatin or hydrophillic colloid is applied using a standard coating and drying process. The amount of the dried gelatin layer preferably ranges from 30 to 500 $mg/m^2$ dry coverage. This gelatin layer provides improved adhesion in combination with the subbing layer containing the glycidyl-functional polymer. If desired, the subbing layer or the non-photosensitive gelatin layer may also comprise various additives such as surface active agents, matting agents, hardeners, dyes, pigments, alkali, acid and salts.

After the subbing and gelatin layers are applied, the support is then annealed at elevated temperatures to provide appropriate support properties such as curl. Annealing conditions are preferably 40 to 5° C. below the glass transition temperature of the support for times ranging from 6 hours to 300 hours, preferably 24 hours to 200 hours. For PET supports, annealing temperatures are preferably 60 to 85° C., and for PEN supports, 80 to 110° C. for relatively longer periods of time. After annealing, a silver-halide photosensitive emulsion is coated thereon and dried.

Polyester supports used for obtaining the subbed polyester support according to the present invention are film-like supports prepared by subjecting a polyester compound, the representative of which is polyethylene naphthalate or polyethylene terephthalate, which is obtained, for example, by condensation polymerization of diol and a dicarboxylic acid containing compound, to extrusion molding to prepare a film and crystallizing the resulting film by biaxial stretching and thermal setting.

Supports which can be used in this invention include any supports of hydrophobic, high molecular weight polyesters. Suitable supports typically have a glass transition temperature (Tg) greater than 90° C. The support may be produced from any suitable synthetic linear polyester which may be obtained by condensing one or more dicarboxylic acids or their lower alkyl esters, e.g. terephthalic acid, isophthalic acid, phthalic acid, 2,5-, 2,6-, and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as povalic acid, with one or more glycols, e.g., ethylene glycol, 1,3-propanediol, 1,4-butanediol, neopentyl glycol and 1,4-cyclohexanedimethanol. Suitable supports include, for example, polyesters such as polyethylene terephthalate, polyhexamethylene terephthalate, polyethylene-2,6-naphthalate, polyethylene-2,5-naphthalate, and polyethylene-2,7-naphthalate. Within the contemplation of the invention are supports based on copolymers and/or mixtures of polyesters based on different monomers.

In one embodiment of the present invention, the support is predominantly made from PEN, an acronym referred to polymers which are constituted substantially from ethylene-2,6-naphthalate units. PEN, however, may have a small portion, for example 10 mol % or less, of other units as a third component. PEN can be usually obtained by polycondensing naphthalene-2,6-dicarboxylic acid or its ester-forming alkyl ester with ethylene glycol in the presence of a catalyst under appropriate reaction conditions. As a third component, there can be mentioned, for example, adipic acid, sebacic acid, terephthalic acid, naphthalene-2,7-dicarboxylic acid, tetramethylene glycol, hexamethylene glycol and polyethylene glycol. The inherent viscosity of PEN is preferred to be in the range from 0.5 to 0.8.

Preferred other ingredients include dibasic acids such as isophthalic acid, phthalic acid, phthalic anhydride, succinic acid, oxalic acid, or lower alkyl esters thereof; oxycarboxylic acids such as p-oxybenzoic acid, p-oxyethyloxybenzoic acid or lower alkyl ester thereof; or glycols such as propylene glycol or trimethylene glycol. The hydroxyl or carboxyl group at the end portion of the polyethylene naphthalate may be terminated with a monofunctional compound such as benzoic acid, benzylbenzoic acid, benzyloxybenzoic acid, or methoxypolyalkylene glycol. Otherwise, the polyethylene naphthalate may be denatured with a slight amount of 3 or 4 functional compounds such as glycerol or pentaerythritol. U.S. Pat. Nos. 5,294,473 and 5,368,997 broadly describe copolyesters with PEN and other polymers.

The polyester film (PEN or blend of PEN) according to one embodiment of the present may be biaxially oriented which can be formed by biaxially stretching PEN as the starting material by any known method. That is, PEN or PEN blend is dried, melt extruded at 280° to 320° C., quenched and solidified to obtain a substantially amorphous unoriented cast sheet. Then the amorphous unoriented sheet is stretched 2–5 times in the machine direction at 120°–170° C., and 2–5 times in the transverse direction at 120°–170° C. Biaxial stretching can be sequential or simultaneous. After stretching, the film base is heat set at a temperature of from 200° to 250° C. for a time of from 0.1 to 10 seconds.

Typical annealing conditions for a film base containing a PEN layer are temperatures of from 90° to 125° C. for times of 6 to 120 hours, which temperature and times may depend on the particular support material, dimensions, and desired properties. See, for example, U.S. Pat. No. 4,141,735 to Schrader et al, for producing a PEN film (or any other high Tg low core set photographic support) and also U.S. Pat. No. 5,759,756 to Laney et al, the latter directed to co-extruding a clear, non-crystallizing polymer at the core of said film. Polyethylene 2,6-naphthalate films having a clear non-crystallizing polymer at the core typically have a thickness of 50 to 180 microns.

Suitable supports are described in Research Disclosure, September 1994, Item 36544 available from Kenneth Mason Publications Ltd, Dudley House, 12 North Street, Emsworth Hampshire PO10 7DQ, England (hereinafter "Research Disclosure") and in Hatsumei Kyoukai Koukai Gihou No. 94-6023, Japan Invention Association, Mar. 15, 1994, available from the Japanese Patent Office. Supports with magnetic layers are described in Research Disclosure, November 1992, Item 34390. The film support of the present invention can contain other components commonly found in film supports for photographic elements. These include dyes, lubricants and particles of organic and inorganic materials such as glass beads. These are described in more detail in Research Disclosure, February 1995, Item 37038, pages 79–114. The supports and associated layers may contain any known additive materials. They may be transparent or can contain a dye or a pigment such as titanium dioxide or carbon black.

The subbed polyester support obtained according to the present invention can be coated with a variety of compositions for forming photographic photosensitive layers, for example, silver-halide photographic emulsions, diazo photosensitive compositions, etc. or gelatin compositions containing antihalation agents or helatin backing compositions for favorably retaining curl balance of support film. Light-sensitive photographic materials obtained by the use of the subbed polyester supports of the present invention are excellent in both dry and wet film adhesion characteristics, and photographic photosensitive layers do not peel off from the supports at all and no adverse effect on photographic properties is brought about.

The silver-halide photographic emulsion can contain a silver-chloride emulsion, a silver bromide emulsion, a silver-chlorobromide emulsion, a silver-bromoiodide emulsion, a silver-chlorobromoiodide emulsion, and the like. The photographic elements, of course, can have multiple silver-halide emulsion layers.

Film base prepared according to the present invention can bear layers commonly found on film support used for photographic elements. These include magnetic recording layers, subbing layers between other layers and the support, photosensitive layers, interlayers and overcoat layers, as are commonly found in photographic elements. These layers can be applied by techniques known in the art and described in the references cited in Research Disclosure, Item 37038 cited above.

Magnetic recording layers that can be used in photographic elements of this invention are described in U.S. Pat. Nos. 3,782,947; 4,279,975; 5,147,768; 5,252,441; 5,254,449; 5,395,743; 5,397,826; 5,413,902; 5,427,900; 5,432,050; 5,434,037; 5,436,120; in Research Disclosure, November 1992, Item 34390, pages 869 et seq., and in Hatsumei Kyonkai Gihou No. 94-6023, published Mar. 15, 1995, by Hatsumei Kyoukai, Japan.

Photographic elements of this invention can have the structure and components shown in Research Disclosure, Item 37038 cited above and can be imagewise exposed and processed using known techniques and compositions, including those described in the Research Disclosure Item 37038 cited above.

Examples of suitable hydrophilic binders for the photographic layer (hydrophilic organic protective colloid), which can be used in this invention, include synthetic or natural hydrophilic high molecular weight gelatin-based compounds, for example, gelatin, acylated gelatin (phthalated gelatin or maleated gelatin), cellulose derivatives such as carboxymethyl cellulose or hydroxyethyl cellulose, grafted gelatin prepared by grafting acrylic acid, methacrylic acid or the amides thereof to gelatin the copolymers thereof or the partially hydrolyzed products thereof. Often these include polymers of monomers having polar groups in the molecule such as carboxyl, carbonyl, hydroxy, sulfo, amino, amido, epoxy or acid anhydride groups, for example, acrylic acid, sodium acrylate, methacrylic acid, iraconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers. These binders can be used individually or in admixture.

Of the above-described binders, gelatin including a gelatin derivative is most generally used, but gelatin can be partially replaced with a synthetic high molecular weight substance.

Especially useful in this invention are tabular grain silver halide emulsions. The average useful ECD (the average equivalent circular diameter of the tabular grains) in micrometers of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements. Emulsion tabularity increases markedly with reductions in tabular grain thickness.

Suitable tabular grain emulsions can be selected from among a variety of conventional teachings, such as those of the following: Research Disclosure, Item 22534, January 1983, published by Kenneth Mason Publications, Ltd., Emsworth, Hampshire PO10 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

In the present invention, other photographically useful materials may also be present in the layer adjacent to the subbed support. These include, for example, black colloidal silver, preformed dyes, ultraviolet absorbing compounds, oxidized developer scavengers, sequestering agents, and the like. These materials may or may not be dispersed in a high-boiling organic liquid. The high-boiling organic liquid used to introduce these agents may or may not be the organic liquids specified in the present invention.

The photographic elements can be single-color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in Research Disclosure, November 1992, Item 34390 published by Kenneth Mason Publications, Ltd., Dudley Annex, 12a North Street, Emsworth, Hampshire PO10 7DQ, ENGLAND, the contents of which are incorporated herein by reference.

Research Disclosure, June 1994, Item 36230 provides information on suitable film adaptions for small format film.

In the following discussion of suitable materials for use in the emulsions and elements of this invention, reference will be made to Research Disclosure, September 1994, Item 36544, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX.

The entire contents of the various patents and other publications cited in this specification are incorporated herein by reference.

The present invention is concretely illustrated below with reference to examples, but it should be construed that embodiments of the invention are not limited only to those examples and they are not to be considered as limiting the scope of the invention. All parts are to be taken as parts by weight.

EXAMPLE 1

Various exemplary types of polymers used to prepare a coating according to the present invention were prepared by standard latex polymerization techniques was as follows. Poly(glycidyl methacrylate) was synthesized by first adding to a 20-gallon, glass-lined reactor 19.14 kg of demineralized water. To a 20-gallon, glass-lined head tank were added 18 kg of demineralized water. The agitators on both vessels were set at 60 RPM. A nitrogen atmosphere was established in the system. Rhodacal® A246L, a surfactant, in the amount of 932.4 g, was rinsed in with 1 kg of demineralized water to the reactor. The reactor contents temperature was set at 60° C. Glycidyl methacrylate (18.75 kg) and 932.4 g of Rhodacal A246L was rinsed in with 1 kg of demineralized water to the head tank. When the monomer emulsion was prepared in the head tank and when the reactor contents temperature was at 60° C., 186.5 g of azobis(4-cyano)valeric acid (75%) was added to the reactor. Within two minutes, pumping of the monomer emulsion into the reactor at 310–320 mL/minute was initiated. The length of the monomer pump was 120 minutes±10 minutes. When the monomer addition was completed, the head tank was rinsed with 2 kg of demineralized water which was pumped through the lines and into the reactor. The reactor contents were stirred for two hours at 60° C. A 12 liter dropping funnel was charged with 3980 mL of demineralized water and 341.6 g of (35%) hydrogen peroxide. The pump was set for 37–40 mL/min. Then was added to the reactor 32 g of erythorbic acid dissolved in 1 kg of demineralized water. Within two minutes, the addition from the 12 liter dropping funnel was initiated. The charge took 30 minutes. When the addition was complete, the flask was rinsed with 1 kg of demineralized water, which was pumped through the lines and into the reactor. The reactor contents were stirred for an additional hour at 60° C. The latex was then cooled to 25° C., and filtered through a 30 micron cartridge filter into clean, five-gallon "Win-Pak" pails. The total yield of latex was 68 kg at 30% solids. Copolymers of glycidyl methacrylate with butyl acrylate, and ethyl were also synthesized. The mole percent of the various monomers are shown in Table 1 below.

Subbed supports were prepared by first coating a solution of the subbing materials onto as-cast PET or PEN. The solution contained 7% of the polymer latex, 1% resorcinol or chloromethylphenol, 0.2% saponin in water. After drying, the subbed PET was stretched and tentered at elevated temperatures resulting in a adhesion layer that is approximately 100 nm thick. To this support, a solution of 1% gelatin, 0.01% saponin in water was applied using standard coating methods and dried to give a dry gel thickness of ~0.1 microns. Samples from these coatings were then annealed at 80° C. for 3 days. Unannealed and annealed samples were then coated with a full photographic emulsion.

The adhesion of these samples was measured using the following tests:

Dry Adhesion Measurement

Dry adhesion of the emulsion side of samples was evaluated both before and after C-41 standard film processing. Samples approximately 1.9 cm wide and 15 cm long were cut from the prepared coatings. A score line is cut across the sample through the emulsion coating near the top of the strip, about 2 cm from the top. A piece of 3M 471¾" Pressure Sensitive Vinyl Yellow Tape is applied onto the sample and excess sample is trimmed away from the tape with a razor blade. The tape is slowly pulled back from the top to the score mark, trying to force the emulsion to peel off with the tape. The sample is placed in an Instron tensile testing machine and the amount of force required to remove the tape/emulsion at a rate of 100 cm/min. is recorded. Peel force values are reported in units of N/m with higher numbers indicating a stronger adhesive bond. If the emulsion could not be peeled off with this tape a "Did not peel" or DNP is reported.

Abrader Wet Adhesion Test

Wet adhesion was measured by a wet abrader test measurements as follows. A 35 mm×12.7 cm strip of coating was soaked at 37.8° C. for 195 seconds in Kodak Flexicolor® Developer Replenisher. The strip was then scored with a pointed stylus tip across the width of the strip and placed in a small trough filled with developer solution. A weighted (900 g) filled natural rubber pad, 3.49 cm diameter, was placed on top. The pad was moved back and forth across the scored line for 100 cycles at one cycle per second,. The amount of emulsion removal was then assessed with a hand scanner and given in units of % area removed. The less removed, the better the wet adhesion.

Load Resolved Wet Wear Test

Wet adhesion was also measured by a load resolved wet wear (LRWW) measurements as follows. The LRWW test is conducted by running a Velcro® hook abrasive pad at five loads, 400 g, 1000 g, 1600 g, 2200 g, and 2800 g, against a developer-soaked film (as in the abrader test) in a reciprocating fashion for 60 cycles. An optical transmission measurement is made after the experiment to measure the amount of emulsion removed from the coating. The recorded composite failure is a linear average of the percent emulsion removed at the five loads.

Table 1 below shows the wet adhesion results for the sub layers according to the present invention. For comparison, on the other hand, samples were prepared in the same manner as above, except that a comparative polymer (a copolymer of acrylonitrile, vinylidene chloride and acrylic acid) was used in place of the above-mentioned exemplified compounds, to prepare samples, and the comparative samples thus prepared were subjected likewise to film adhesion tests. Each sample was annealed and, for comparison, unannealed. The results obtained in the tests of the present samples and comparative samples were as shown in Table 1 below.

TABLE 1

| Sample | Support | Coalescing Aid | Polymer Subbing | Annealed | Abrader Test (% removed) | LRWW (%) |
|---|---|---|---|---|---|---|
| 1 Control | PEN | Resorcinol | P1 | No | 0 | 4 |
| 2 (Comparison) | PEN | Resorcinol | P1 | Yes | Variable 0 to 90 | Variable 10 to 70 |
| 3 Control | PET | Resorcinol | P1 | No | 0 | 4 |
| 4 (Comparison) | PET | CMP | P2 | No | 98 | 89.3 |
| 5 | PET | CMP | P2 | Yes | 2.6 | 12.3 |
| 6 (Comparison) | PET | Resorcinol | P3 | No | 95 | 79.1 |
| 7 | PET | Resorcinol | P3 | Yes | 0 | 14.8 |
| 8 (Comparison) | PET | Resorcinol | P4 | No | 9 | 34.4 |
| 9 | PET | Resorcinol | P4 | Yes | 0 | 18.5 |

In Table 1 above, the polymers P1 to P4 were as follows:

P1=copolymer of acrylonitrile, vinylidene chloride and acrylic acid;

P2=poly(glycidyl methacrylate);

P3=poly(glycidyl methacrylate-co-butylacralate) 73/27 mole ratio;

P4=poly(glycidyl methacrylate-co-ethylacrylate) 68/32 mole ratio; and

CMP choloromethylphenol.

As is clear from Table 1, it is understood that the samples prepared according to the present invention are excellent in film adhesion force. In contrast, the comparative samples fail to exhibit film-adhesion force sufficient for practical use.

In addition, the dry adhesion of samples 2–10 were also evaluated before and after photographically processing the film. All the unprocessed samples had a dry adhesion test result of DNP. For the processed samples only sample 6, the unannealed poly(glycidyl methacrylate-co-ethylacrylate) 75/25 showed removal in the dry adhesion test with a peel force of 133 N/m. The other processed samples had a result of DNP with this test.

The invention has been described in detail with particular reference to certain preferred embodiments thereof, but it will be understood that variations and modifications can be effected within the spirit and scope of the invention.

What is claimed is:

1. A method of manufacture for subbing a photographic polyester support comprising in order:

(a) coating an aqueous polymer composition onto said support in line to form a subbing layer, wherein the aqueous polymer composition contains a polymer or copolymer comprising 50 to 100 mole percent of glycidyl acrylate and/or glycidyl methacrylate monomer;

(b) coating a non-photosensitive gelatin-containing composition onto said subbing layer; and (c) annealing the coated subbing layer from step (b) at a temperature that is 40 to 5° C. less than the glass transition of the support, and that is at least 60° C., for at least 6 hours.

2. A method according to claim 1 wherein, after annealing, a photosensitive silver-halide containing emulsion is coated and dried over the non-photosensitive gelatin-containing composition.

3. A method according to claim 1 wherein the aqueous polymer composition contains further a surface active agent.

4. A method according to claim 1 wherein the photographic polyester support is a polyethylene terephthalate or polyethylene naphthalate film.

5. A method according to claim 1 wherein the photographic polyester support is a biaxially stretched polyethylene terephthalate or polyethylene naphthalate film.

6. A method according to claim 1 wherein the support comprises polyethylene naphthalate, including supports comprising polyester blends and coextruded layers.

7. A method according to claim 1 wherein the temperature is 80 to 120° C., and the time is 24 to 200 hours.

8. A method according to claim 1 wherein the aqueous composition further comprises, as a coalescing agent, a compound in which one or more hydroxy groups are substituted on an aromatic ring.

9. A method according to claim 8 wherein the coalescing agent is chloromethylphenol.

10. A method according to claim 1 wherein the polymer composition is coated and dried on the polyester support at a coverage of about 0.3 to 3 g of polymer solids per $m^2$ of support.

11. A method according to claim 1 wherein the aqueous polymer composition is coated onto a continuous web of polyester support material, which is cut into film strips after the coated support material is annealed.

12. A method of manufacturing a photographic film comprising in order:

(a) coating an aqueous polymer composition onto a photographic polyester support in the form of a continuous web to form a subbing layer, wherein the aqueous polymer composition contains a polymer or copolymer comprising 50 to 100 mole percent of glycidyl acrylate and/or glycidyl methacrylate monomer;

(b) coating a non-photosensitive gelatin-containing composition onto said subbing layer; and (d) annealing the coated subbing layer from step (b) at a temperature that is 40 to 5° C. less than the glass transition of the support, and that is at least 60° C., for at least 6 hours;

(e) after annealing, coating and drying a photosensitive silver-halide containing emulsion over the non-photosensitive gelatin-containing composition; and (f) cutting the material from step (f) into film strips.

* * * * *